United States Patent [19]

Owen

[11] Patent Number: 5,021,222

[45] Date of Patent: Jun. 4, 1991

[54] RESID CRACKING APPARATUS

[75] Inventor: Hartley Owen, Belle Mead, N.J.

[73] Assignee: Mobil Oil Corporation, Fairfax, Va.

[21] Appl. No.: 438,836

[22] Filed: Nov. 20, 1989

Related U.S. Application Data

[62] Division of Ser. No. 259,561, Oct. 18, 1988, Pat. No. 4,895,637.

[51] Int. Cl.[5] ..... F27B 15/08

[52] U.S. Cl. ..... 422/144; 422/145; 422/146; 208/113

[58] Field of Search ..... 422/144–147, 422/200, 198; 165/104.16; 208/113

[56] References Cited

U.S. PATENT DOCUMENTS

| | | | |
|---|---|---|---|
| 2,742,403 | 4/1956 | Nicholson et al. | 196/49 |
| 2,877,175 | 3/1959 | MacLaren | 208/149 |
| 2,894,902 | 7/1959 | Nicholson et al. | 208/149 |
| 2,952,618 | 9/1960 | MacLaren | 208/149 |
| 3,886,060 | 5/1975 | Owen | 208/120 |
| 4,223,843 | 9/1980 | Smith et al. | 422/144 X |
| 4,371,501 | 2/1983 | Vickers | 422/146 X |
| 4,388,218 | 6/1983 | Rowe | 422/144 X |
| 4,814,068 | 3/1989 | Herbst et al. | 208/113 X |
| 4,851,374 | 7/1989 | Yan et al. | 422/144 X |
| 4,875,994 | 10/1989 | Haddadd et al. | 208/113 |
| 4,895,636 | 1/1990 | Chen et al. | 208/113 |

*Primary Examiner*—Robert J. Warden
*Assistant Examiner*—Rebekah A. Griffith
*Attorney, Agent, or Firm*—Alexander J. McKillop; Charles J. Speciale; Richard D. Stone

[57] ABSTRACT

This application is directed to a process and apparatus for regenerating an elutriable mixture of fluidized catalytic cracking (FCC) catalyst and a demetallizing additive. Deactivated catalyst and coke containing additive are added to a single dense bed regenerator. Within the regenerator, differences in settling velocity segregate the elutriable mixture into a lower dense bed containing most of the additive and a contiguous upper dense bed containing most of the FCC catalyst. Some regeneration gas is added to the lower dense bed to at least partially decoke the additive, while additional regeneration gas is added to the upper dense bed. Decoked additive and regenerated FCC catalyst are preferably withdrawn separately and charged to a riser reactor for demetallizing and catalytic cracking of heavy feed. Flue gas is withdrawn from the regenerator from a dilute phase vapor space above the single dense bed.

7 Claims, 2 Drawing Sheets

RESID CRACKING APPARATUS

This is a divisional of copending application Ser. No. 259,561, filed on Oct. 18, 1988, and now U.S. Pat. No. 4,895,637.

BACKGROUND OF THE INVENTION

The FCC, or fluidized catalytic cracking process, is a mature process. It is used to convert relatively heavy, usually distillable, feeds to more valuable lighter products. There is an increasing need in modern refineries to convert more of the "bottom of the barrel" to more valuable lighter products, e.g., resids or residual oil fractions.

In the past these heavy streams were subjected to various thermal processes such as coking or visbreaking to convert them to more valuable products. Unfortunately, thermal processing alone has not proved to be a complete answer to the problem, as the products of thermal cracking are themselves relatively low valued products, such as heavy fuel oil from visbreaking or coker naptha or coker gas oil from coking operations. In the case of coking, very large coke yields result in large volumes of low value product.

Residual oils have a large percentage of refractory components such as polycyclic aromatics which are difficult to crack. Resids also contain large amounts of metals which rapidly deactivate conventional catalyst. Some attempts at catalytic processing of these stocks have been made e.g., adding relatively small amounts of residual oil to conventional FCC feed. FCC units can tolerate modest amounts of resids in the feed, e.g., 5–10 wt percent but the heavy feeds increase the burning load on the regenerator (because of their high Conradson carbon content) and poison the catalyst, with nickel and vanadium. Limiting the amount of resid in the FCC feed has been the method of choice in controlling regeneration operation, although consideration has been given to adding catalyst coolers. The nickel and vanadium contamination problem can be overcome to some extent by practicing metals passivation, e.g., addition of antimony to the unit to passivate the metals added with the feed. Metals passivation has allowed FCC units to continue operating with catalyst containing relatively high amounts of nickel and vanadium, but has not been a complete solution. The vanadium seems to attack the zeolite structure of modern FCC catalyst, resulting in rapid loss of catalyst activity. The exact cause of vanadium poisoning is not completely understood, but it is believed that oxidized vanadium compounds are formed in the highly oxidizing atmosphere of conventional FCC regenerators and these compounds, particularly vanadic acid rapidly attack the zeolite. The problem is discussed in Vanadium Poisoning of Cracking Catalyst, Wormsbecher et al, Journal of Catalysis, 100, 130–137 (1986).

Most refiners now monitor the metals concentration on their catalyst and dump equilibrium catalyst and replace it with fresh catalyst to control the average level of metal on the catalyst. Such a solution is expensive because it can result in very high catalyst replacement rates.

Another approach to adding residual oils to FCC units is described in U.S. Pat. No. 3,886,060, which is incorporated herein by reference. Residual oil was used as a quench medium to limit the conversion of a recycle oil in a riser conversion zone. The preferred catalysts were dual components, i.e., containing both large and small pore size zeolites. A single regenerator operated with dual riser reactors.

Despite the many improvements which have been made, attempts to crack resids have not been too successful, primarily because of the large amounts of metal and coke associated with such feeds. We have now discovered a way to handle such difficult stocks in a single riser reactor, using a two stage regenerator. In this approach, we use a mixture of coarse and conventional catalyst in a single riser reactor with a two stage regenerator to achieve some unusual results.

By careful selection of the catalyst sizes and of the superficial vapor velocities in the catalyst regenerator it is possible to keep the coarse catalyst effectively segregated from the conventional catalyst. The coarse catalyst is regenerated in a single stage, under relatively mild conditions which minimize oxidation of vanadium compounds on the catalyst but which still remove much of the hydrogen content of the coke and eliminate most of the water precursors. The conventional FCC catalyst is regenerated to some extent in the first stage regenerator, and then undergoes a second stage of regeneration, at a higher temperature, with higher oxygen concentrations. Use of two different kinds of catalyst, in a two stage regenerator, permits significantly higher metals levels to be tolerated in the feed.

A BRIEF DESCRIPTION OF THE INVENTION

The present invention provides a fluidized catalytic cracking process wherein a heavy, metals laden feed contacts hot regenerated catalytic cracking catalyst in a riser reactor, the feed is cracked to lighter products and the cracking catalyst is coked, catalyst is separated from cracked products in a separation means, coked catalyst is stripped of strippable hydrocarbons with a stripping gas, the stripped catalyst is regenerated with an oxygen-containing gas in a regeneration zone, and the regenerated catalyst is recycled to the riser to contact more heavy feed characterized by cracking heavy feed in a riser reactor with an elutriable mixture of fluidizable catalytic cracking catalyst having a settling velocity and an additive material having a higher settling velocity than the cracking catalyst whereby the additive material and cracking catalyst when placed in a common fluidized dense phase bed will segregate to form an additive rich lower dense phase bed and a cracking catalyst rich upper dense phase bed; regenerating said elutriable mixture in a regenerator comprising a single dense phase fluidized bed having an additive rich lower dense phase bed and a catalyst rich upper dense phase bed contiguous with at least a portion of the lower dense phase by adding an oxygen-containing gas to the additive rich dense bed to at least partially decoke the additive, and adding an oxygen-containing gas to the upper dense bed and regenerating the cracking catalyst in the upper dense bed; removing the at least partially decoked additive from the additive rich lower dense bed and recycling the additive to the riser reactor for contact with the feed; separately removing the regenerated cracking catalyst from the upper dense bed and recycling the removed catalyst to the riser reactor.

In an apparatus embodiment, the present invention provides an apparatus for fluidized bed combustion of an elutriable mixture of particles comprising a vessel having: an inlet for adding the elutriable particle mixture; a lower combustion gas inlet for admitting combustion air; an upper combustion gas inlet for admitting additional combustion air to an upper portion of the combustion zone; a lower particulate outlet for removing particles from a lower portion of the combustion zone; an intermediate particulate outlet for removing particles from the combustion zone, the intermediate outlet being located above the lower outlet; an upper outlet for removal of a flue gas stream produced by combustion in the fluidized beds.

BRIEF DESCRIPTION OF THE DRAWINGS

FIG. I represents a prior art FCC regenerator.

FIG. II represents an FCC regenerator of the invention, with two stages of air addition and two stages of catalyst withdrawal.

DETAILED DESCRIPTION

Figure 1:
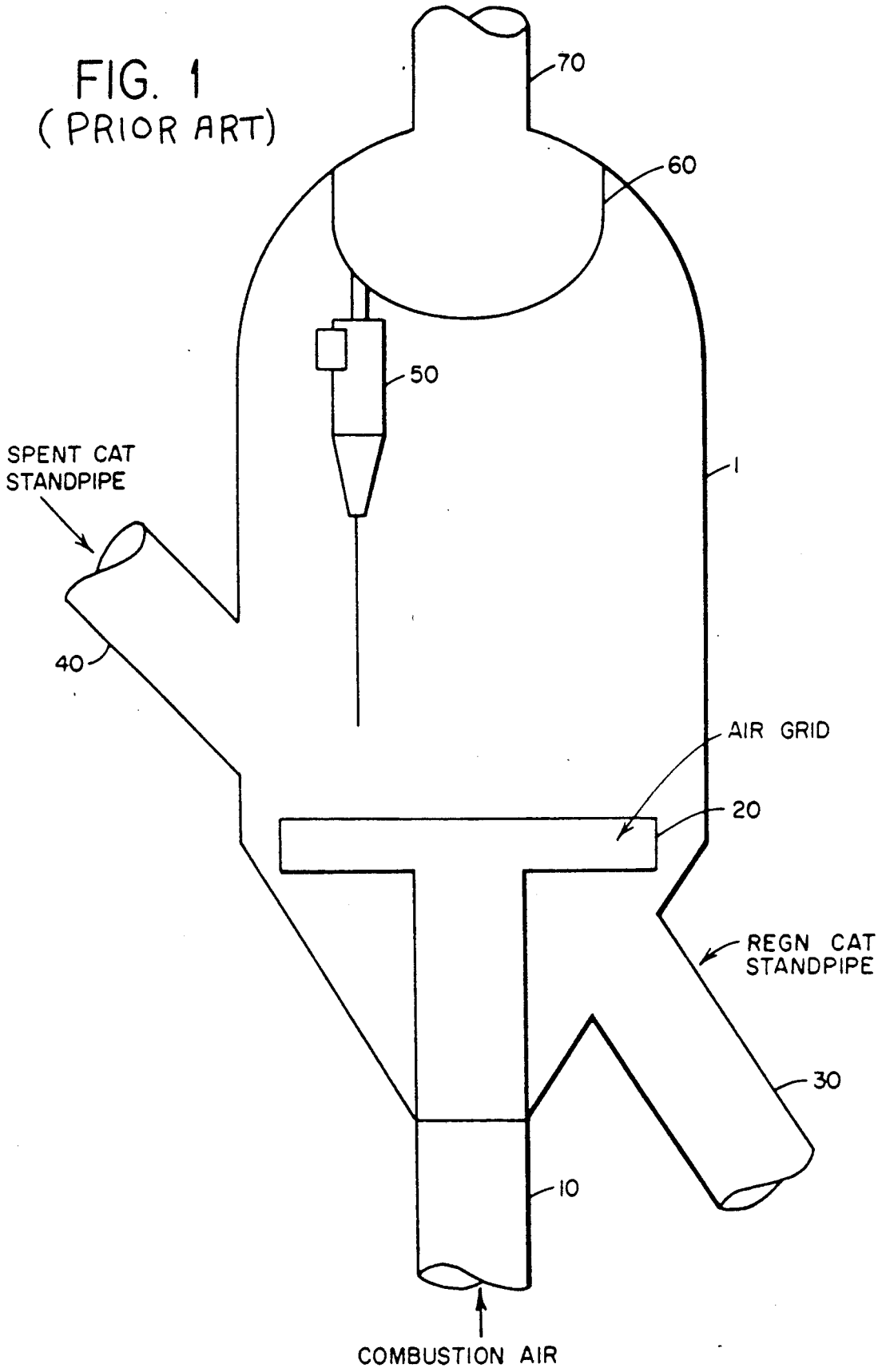
FIG. 1 (PRIOR ART)

FIG. I represents a prior art FCC regenerator using a single dense bed.

FCC regenerator 1 receives spent catalyst from the FCC unit via line 40. Combustion air is added via line 10 and air grid 20. The air burns coke from the catalyst. Hot regenerated catalyst is removed via line 30 for reuse in the FCC reactor. Flue gas formed during coke combustion is discharged via cyclone 50 (which recovers the entrained FCC catalyst), plenum chamber 60 and outlet 70.

FIG. II, which represents one preferred embodiment of the present invention, shows a revamped FCC regenerator 1 (the outer shell of the regenerator can be identical, so identical elements have the same numbers in FIGS. I and II). A mixture of spent catalyst and coked heavy, vanadium getter additive is added to the regenerator via line 40. The relatively heavy, or larger, vanadium getter additive sinks to the bottom of the regenerator 1 because the additive settles faster than the conventional FCC catalyst. The getter additive is decoked to some extent, but preferably still contains some coke, e.g., 0.1 wt% coke or more, in the base of the regenerator by the addition of secondary air via line 210 and distributor ring 220 in the very base of the regenerator. Temperatures tend to be extremely high in the regenerator of the present invention, primarily because of the increased burning duty forced upon the regenerator by the processing of heavy, residual feeds containing large amount of Conradson carbon and similar materials. The additive is preheated to some extent in passing through the dense bed of conventional catalyst 260, in its descent to the base region 250 of the FCC regenerator.

The conventional catalyst is regenerated in dense bed 260, primarily with primary combustion air added via inlet 110 and primary air ring 120. Regenerated catalyst is withdrawn via line 130 and discharged to the FCC riser reactor, preferably at an intermediate point thereof.

To remove some of the excess heat in the regenerator, steam coils 270 are preferably present in the lower region 250. Catalyst may be added to or removed from region 250 to a cooler or heat exchanger (not shown) via line 330.

Filler or spacers 220 are shown to better define the lower region 250 and separate it from the upper region 260 wherein relatively lighter catayst is segregated. The fillers or inserts 220 provide a relatively large change in superficial vapor velocity within the regenerator, which improves the separation, by elutriation, of relatively fast settling getter additive from the more readily fluidizable conventional FCC catalyst.

Although it is preferred to add the partially decoked particles in line 230 to the base of the riser reactor, and to add the regenerated conventional FCC catalyst in line 130 to a somewhat higher portion of the riser reactor, it is also within the scope of the present invention to comingle decoked additive and regenerated catalyst and add the commingled stream to the base of a riser reactor.

In the riser reactor the decoked getter additive will have a longer residence time than the conventional catalyst. This is because the decoked additive will have much higher settling velocity, preferably a settling velocity which is 50–100 percent of the superficial vapor velocity at the base of the riser reactor.

The base of the riser reactor may be broadened (to decrease the superficial vapor velocity and provide for additional contact time of the getter additive with the fresh feed) or straight. It is also within the scope of the present invention to have split feed to the FCC riser reactor. If split feed injection is practiced, preferably the feed with the most metals content, and highest CCR content, is added first, to contact the getter additive. The conventional feed, and the conventional hot, regenerated FCC catalyst, may then be added to higher portions of the riser.

HEAT REMOVAL

It will usually be preferred to have at least one method of removing heat from the regenerator. Although steam coils are shown only in region 250 in FIG. II, it is acceptable to have steam coils in the upper section 260 of the dense bed of the regenerator, or in the dilute phase region of the regenerator 1. Catalyst coolers may also be used to remove heat from decoked particles in line 230, or regenerated catalyst removed via line 130.

Preferably, air addition, and consequently coke combustion, along with heat removal from the regenerator is adjusted so that the decoked getter additive is much hotter than the conventional FCC catalyst. The high temperature, decoked getter additive will be very efficient at vaporizing heavy, resid-containing feedstocks and rapidly demetallize the crude. The conventional cracking catalyst, whether added at about the same point as the decoked getter additive, or added higher up in the riser, can be at a somewhat lower temperature, to quench the thermal reactions provoked by the hot, decoked getter additive. There could be a very sharply defined high temperature zone at the base of the riser, followed by quench of the riser with somewhat cooler regenerated catalyst higher up in the riser, or by addition of other hydrocarbon streams higher up in the riser. If other, relatively low temperature hydrocarbon streams, or other vaporizable fluids such as water, are added higher up in the riser, then any temperature profile desired can be imposed on the riser reactor.

When relatively higher temperature getter and somewhat cooler regenerated FCC catalyst are simply added to the base of the riser, there can be a localized high temperature thermal zone around the getter additive, with somewhat lower temperatures around the conventional cracking catalyst.

By allowing conventional catalyst and getter additive to freely commingle in the riser, but be separated in the regenerator, an extremely simple, reliable means of removing metals from resid feeds can be achieved. The system is relatively "fail safe" in that if some conventional catalyst is entrained in the getter additive, and passes through region 250 and via line 230 to the base of the riser to contact fresh, resid-containing feed, the conventional catalyst will be protected to some extent from metals deposition by the presence of relatively large amounts of getter additive. The conventional FCC catalyst and getter additive will pass together through the FCC riser reactor, conventional stripper, and back into the regenerator, where they will have another chance to be separated.

If any of the getter additive happens to be swept into the FCC catalyst return line 130, it will simply be swept up the FCC riser reactor, to be eventually segregated with its fellows in getter bed 250.

Most of the getter additive, preferably more than 90 percent or more, will pass by elutriation or settling or density differences to the base of the regenerator 1 and be regenerated in a relatively reducing atmosphere. This will minimize the formation of highly oxidized forms of vanadium. The decoking of the getter additive in bed 250 will occur in a relatively low moisture zone. Most of the water in an FCC regenerator comes from water of combustion (via burning of hydrogen in the hydrocarbonaceous coke) and from stripping steam that is entrained with catalyst entering the regenerator. These two sources of water will be largely removed in the present invention, because essentially all of the stripping steam will be removed as getter additive passes through bed 260. Much, probably a majority, of the hydrogen in the coke will also be burned in the relatively short residence time of getter additive in bed 260 as it passes down to bed 250.

The process of the present invention is extremely efficient for regenerating catalyst while minimizing emissions of both $NO_x$ and carbon monoxide. This is unusual behavior, in that designs which minimize $NO_x$ emissions tend to maximize carbon monoxide emissions.

$NO_x$ emissions can be minimized by running the dense bed portion 250 of the regenerator with a relatively reducing atmosphere. This will minimize $NO_x$ emissions. Much CO will be formed (usually there will be an equimolar mixture of carbon monoxide and carbon dioxide as a result of combustion in bed 250). This would normally result in an intolerable amount of CO emissions, however the carbon monoxide can be completely burned in the dense bed 260 without causing afterburning in the dilute phase portion of regenerator 1. The CO can be afterburned both because additional air is added (the primary air added via line 110 and primary air ring 120) and because CO combustion promoter can be present in the system. CO combustion promoters, such as 0.01 to 50, preferably 0.5 to 5 wt ppm platinum based on catalyst inventory, added as platinum on alumina, or solutions of chloroplatinic acid added to the circulating catalyst, are well known. The process of the present invention permits extremely efficient use of CO combustion promoters, especially of Pt-alumina additives with particle sizes similar to that of conventional FCC catalyst. These CO combustion promoters will congregate in bed 260. This permits relatively sloppy addition of secondary air via air inlet 210 and air ring 220. There is no fear of afterburning above dense bed 250 because of poor air distibution, or poor control of the amount of air added. All air added via inlet 210 will be consumed in bed 260, both in regenerating the conventional FCC catalyst and in combusting the carbon monoxide formed in bed 250.

$NO_x$ emissions are minimized in the present invention because much of the coke combustion occurs in the region 250, characterized by a relatively reducing atmosphere which minimizes $NO_x$ formation.

HOT STRIPPER

Although not shown in the drawing, it is preferred that a hot stripper, in addition to the conventional steam stripper, be used intermediate the conventional catalyst stripper and the regenerator of the invention. The catalyst stripper can be made hotter by the addition of flue gas or hot regenerated catalyst. The use of a hot stripper is preferred because it increases the recovery of valuable liquid hydrocarbon products and reduces the amount of hydrocarbons that are burned in the regenerator. The hot stripper also reduces the amount of water of combustion formed in the regenerator.

The present invention can be easily practiced in many existing single bed regenerators by making the following changes.

Figure 2:
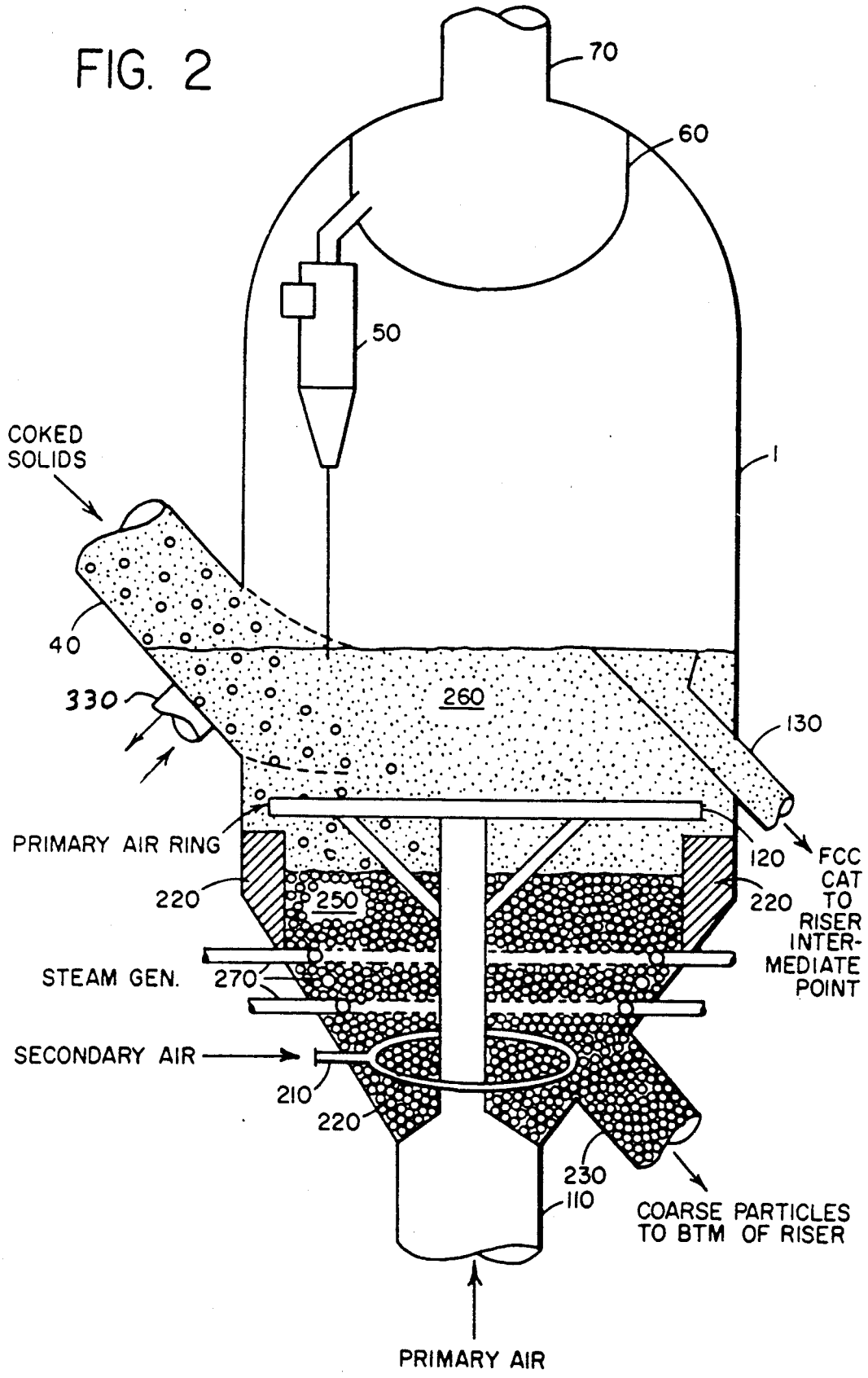

First the core section would be filled with a filler such as element 220 FIG. 2 to decrease its diameter (area) considerably along with elevating the present air grid. The present air grid may be made lighter and smaller as it would not take as much air.

Preferably, the overflow well would be raised some and would discharge active catalyst to an intermediate point on the riser. Some riser modifications will of course be required to accomodate two catalyst feed points. Running a higher average bed depth in the regenerator will help accommodate the coarse additive or "getter". A new catalyst circulation line (e.g., line 230) is added at the bottom of the core to recycle the low activity (inert or metals "getter") particles to the base of the riser. The steam generating coils 270 in the modified conical section are preferably added (or a new catalyst cooler tied in here). A good place to locate the catalyst cooler is in the regenerated catalyst return line, because the particles are easily and smoothly fluidized.

A new air ring (e.g., ring 220) must be installed in the conical section to take a major portion e.g., 50–90% of the air. This may not be a ring but a "sparger" injecting the air in over a range of depths to separate out fine FCC catalyst from the larger particles more efficiently.

Catalyst can be conventionally FCC catalyst. It may have a particle size, or average diameter of 30–100 microns.

Additive materials preferably have a high affinity for metals, such as vanadium. Relatively large particles of relatively soft alumina are preferred. Preferably, the additive has an average particle diameter at least 20% larger, and most preferably 100% larger, than the cracking catalyst and an average bulk density at least 10 percent higher than the cracking catalyst.

Feeds can be conventional, but the greatest economic returns will be realized when large amounts of resid, asphaltenes, etc. are included, e.g., 10–100% resid feed, exclusive of recycle streams.

What is claimed is:

1. An apparatus for fluidized bed combustion of, and elutriation of, a stream of a mixture of elutriable particles, comprising relatively fluidizable particles and relatively heavier particles which are relatively faster settling in dense phase fluidized beds than said relatively light fluidizable particles, comprising:

(a) a single vessel adapted to maintain said elutriable mixture as a single dense phase fluidized bed and to elutriate said mixture by contact with an upflowing combustion gas stream into an upper dense phase fluidized bed portion enriched in relatively light fluidizable particles and a contiguous lower dense phase fluidized bed portion enriched in relatively fast settling particles;

(b) an inlet means connective with said vessel for admission of said elutriable particle mixture;

(c) an upper combustion gas inlet means in said upper portion of said single dense phase fluidized bed;

(d) a lower combustion gas inlet means in said lower portion of said single dense phase fluidized bed;

(e) a flue gas outlet means connective with a dilute phase region above said single dense phase fluidized bed for withdrawal of a flue gas stream;

(f) an upper particle outlet connective with said upper portion of said single dense phase fluidized bed for withdrawal of a stream of particles rich in relatively light fluidizable particles from said single dense phase fluidized bed; and (g) a lower particle outlet connective with said lower portion of said single dense phase fluidized bed for withdrawal of a stream of particles enriched in relatively light fluidizable particles.

2. The apparatus of claim 1 wherein said vessel has a cross sectional area in said upper dense phase fluidized bed region and a reduced cross sectional area in said contiguous lower dense phase fluidized bed region.

3. The apparatus of claim 1 further comprising a heat exchange means.

4. The apparatus of claim 3 wherein said heat exchange means is in said lower dense phase fluidized bed region.

5. The apparatus of claim 1 wherein said particulate mixture inlet means discharges said mixture of elutriable particles into said upper dense phase region.

6. The apparatus of claim 1 wherein said relatively light fluidizable particles have an average diameter of 30–100 microns.

7. The apparatus of claim 6 wherein said relatively fast settling particles have an average particle diameter at least twice that of said relatively light fluidizable particles.

* * * * *